US010174459B2

(12) United States Patent
Mießbacher et al.

(10) Patent No.: US 10,174,459 B2
(45) Date of Patent: Jan. 8, 2019

(54) ANGLED GUIDE PLATE FOR A RAIL PROFILE

(71) Applicant: Semperit AG Holding, Vienna (AT)

(72) Inventors: Herwig Mießbacher, Großlobming (AT); Stefan Reinthaler, Trattenbach (AT); Mario Schöngrundner, Schottwien (AT)

(73) Assignee: Semperit AG Holding, Vienna (AT)

( * ) Notice: Subject to any disclaimer, the term of this patent is extended or adjusted under 35 U.S.C. 154(b) by 192 days.

(21) Appl. No.: 15/030,282

(22) PCT Filed: Oct. 10, 2014

(86) PCT No.: PCT/EP2014/071790
§ 371 (c)(1),
(2) Date: Apr. 18, 2016

(87) PCT Pub. No.: WO2015/055540
PCT Pub. Date: Apr. 23, 2015

(65) Prior Publication Data

US 2016/0237627 A1 Aug. 18, 2016

(30) Foreign Application Priority Data

Oct. 18, 2013 (DE) ..... 10 2013 221 175

(51) Int. Cl.
*E01B 9/60* (2006.01)
*E01B 9/28* (2006.01)

(52) U.S. Cl.
CPC . *E01B 9/60* (2013.01); *E01B 9/28* (2013.01)

(58) Field of Classification Search
CPC ... E01B 9/303; E01B 9/30; E01B 9/02; E01B 9/306; E01B 9/483; E01B 9/685; E01B 9/486; E01B 9/28; E01B 9/60
(Continued)

(56) References Cited

U.S. PATENT DOCUMENTS

2014/0103132 A1 4/2014 Lienhard et al.

FOREIGN PATENT DOCUMENTS

CN 1094773 11/1994
CN 1103687 6/1995
(Continued)

OTHER PUBLICATIONS

European Patent Office; International Search Report; dated Jan. 27, 2015.

*Primary Examiner* — Mark T Le
(74) *Attorney, Agent, or Firm* — Price Heneveld LLP

(57) ABSTRACT

An angled guide plate, in particular for rail fastening systems, includes a basic body that has an upper side and an underside, wherein the underside is designed for arranging on a further element, in particular a railway sleeper, whereas the upper side describes an opposite plane substantially transversely to the railway sleeper and wherein the angled guide plate consists of a guide region and a supporting region, wherein the guide region and the supporting region extend substantially parallel and adjacent to one another in a direction transverse to a track direction, and wherein the upper side and the underside are spaced apart from one another so that a thickness of the supporting region, as measured substantially perpendicularly to the underside, is larger, at least in part, than a thickness of the guide region.

15 Claims, 6 Drawing Sheets

(58) Field of Classification Search
USPC ..... 238/349, 351
See application file for complete search history.

(56) References Cited

FOREIGN PATENT DOCUMENTS

| | | | | |
|---|---|---|---|---|
| CN | 1985050 | | | 6/2007 |
| DE | 20 2011 107 123 | | | 3/2012 |
| DE | 10262248 | B2 | | 11/2012 |
| DE | 10 2012 100 440 | A1 | | 7/2013 |
| EP | 0767274 | | | 4/1997 |
| EP | 0767274 | A1 | | 9/1997 |
| JP | 4-228701 | | * | 8/1992 |
| RU | 117156 | | | 2/2012 |
| WO | 2004048697 | | | 6/2004 |
| WO | WO 2004048697 | | * | 6/2004 |
| WO | 2012010269 | | | 1/2012 |
| WO | 2012 167947 | A1 | | 12/2012 |

* cited by examiner

ANGLED GUIDE PLATE FOR A RAIL PROFILE

BACKGROUND OF THE INVENTION

This invention relates to an angled guide plate as well as a track arrangement, in particular for rail fastening systems.

Angled guide plates are known from the prior art. They are used for fastening systems for railway superstructures. In particular, the rails are fixed and guided with angled guide plates of the type in question. For this purpose, the angled guide plates are placed on (railway) sleepers, generally made of concrete, and screwed with these sleepers by means of already cast-in dowels with screws, together with corresponding tension clamps that press from above onto a rail base of the corresponding rail. As a result, extreme forces act on the angled guide plate. While the angled guide plates were made of cast iron in the past, it is known today to make them of plastic. However, the current angled guide plates made of plastic do not have a design suitable to the material and their implementation is not appropriate for plastic. This being, it is disadvantageous in particular that the partly unnecessarily high use of material causes high costs and results to long cycle times for the manufacturing thereof.

Therefore, the aim of this invention is to make available an angled guide plate, in particular for rail fastening systems, that is optimally designed considering the forces that may occur and that thus makes possible cost saving and shortest cycle times for the manufacturing.

SUMMARY OF THE INVENTION

According to the invention, an angled guide plate, in particular for rail fastening systems, comprises a basic body that has an upper side and an underside, wherein the underside is designed for arranging on a further element, in particular a (railway) sleeper, whereas the upper side describes an opposite plane substantially transversely to the (railway) sleeper and wherein the angled guide plate consists of a guide region and a supporting region, wherein the guide region and the supporting region extend substantially parallel and adjacent to one another in a direction transverse to a track direction, wherein the upper side and the underside are spaced apart from one another so that a thickness of the supporting region, as measured substantially perpendicularly to the underside, is larger, at least in part, than a thickness of the guide region. The main functions of the angled guide plate are the mechanical decoupling of the horizontal wheel force between the rail and the (railway) sleeper, the electrical insulation between the rail and the (railway) sleeper as well as the fastening and the guiding of the rail in track direction by frictional engagement. This being, the track direction describes the direction along which the track extends. In order to achieve these purposes, the angled guide plate is designed for locking and supporting further rail fastening means such as, for example, (tension) clamps. Angled guide plates of the type in question are particularly preferably used for so-called elastic direct fastening systems such as, in particular, the "W-type" fastening system. The "W-type" fastening system substantially comprises the following components: angled guide plate, intermediate layer, (tension) clamp, (sleeper) screw and dowel. Angled guide plates of the type in question advantageously replace the known angled guide plates of cast iron. However, the angled guide plates known from the prior art made of plastic do not have a design appropriate for plastic and the costs thereof are not optimized. As a consequence, the use of material is high and there result high component costs, long cycle times for manufacturing that result in low manufacturing capacities as well as great efforts for ensuring the geometry and the mechanical properties due to the construction not appropriate for plastic. Thus, the angled guide plate has advantageously a basic body that has a guide region as well as a supporting region, wherein the thickness of the supporting region is larger, at least in part, than the thickness of the guide region. This being, it should be noted that the "thickness" can always only refer to a precise region or cross-section since the thickness advantageously continuously reduces from the supporting region to the guide region. There is, so to speak no "thickness" of the guide region or of the supporting region. The "in part" applies to along the track direction as well as transversely thereto. In a preferred embodiment, the thickness of the supporting region is higher than the thickness of the guide region. The supporting region and the guide region merge preferably smoothly or seamlessly so that there is not generally any transition visible or any discernible separation line. It is decisive that the thickness of the basic body reduces approximately continuously from the supporting region in direction of the guide region. In this context, it should be considered that the basic body does not comprise any protrusions, recesses, runoff and/or supporting surfaces etc. but that the matter is, for the basic body, literally of the basic shape of the angled guide plate. It should also be mentioned in particular that the thickness should not be read as any local protrusions or recesses that can naturally also influence the thickness of the angled guide plate, at least locally. The continuous reduction of the thickness of the basic body from the supporting region in direction of the guide region does not have to be carried out along a line but can also be stepped (like steps of stairs). The only decisive element is the "basic body" of the angled guide plate that is characterized in that its thickness in the guide region is smaller (at least in part) than in the supporting region. The supporting region of the angled guide plate is in particular the region that is directly or indirectly adjacent to the rail and thus supports it transversely to the track direction. Preferably, the thickness of the supporting region is configured bigger than the thickness of the guide region. Preferably, the guide region serves to align and to guide the angled guide plate on the (railway) sleeper. The thickness of the guide region is advantageously correspondingly smaller than the thickness of the supporting region. Preferably, a minimal thickness of the guide region is smaller than approximately 10 mm. For the arrangement of the underside on the further element, in particular on the (railway) sleeper, the underside can advantageously have an even surface but it can also have a structure that is just not even at least in part, for example nubs, striations or a fluting. The underside can also preferably comprise a wear protection layer that is characterized in particular in that its hardness and/or its friction coefficient is higher (or even lower, depending on the further element on which the angled guide plate is placed) than a hardness or a friction coefficient of the rest of the material of the angled guide plate. It is understood that a wear protection layer can also advantageously be provided towards the rail, thus on a stop surface of the angled guide plate that will still be described in more detail below. This being, it should be noted that the angled guide plate is preferably made of plastic, in particular preferably of a composite material made of a plastic material and of an additional material such as, for example, glass fibre. In a preferred embodiment, the angled guide plate is made of a polyamide 6 with 30% glass fibre (PA6GF30). The wear protection layer that has been mentioned can be achieved by a surface treatment but it can also consist of an additional material that can be applied or sprayed on the underside. The supporting region and the guide region appropriately divide the angled guide plate approximately in a ratio of 1:1, this been seen transversely to the track direction. It is understood that any other ratio is also possible such as, for example 2:1 or 1:2 or also intermediate ratios. The load optimized angled guide plate makes possible a use of material that is reduced by approximately 10 to 30%, depending on the embodiment. This does contribute to a considerable reduction of the production costs. Moreover, the cycle times for the manufacturing are extremely reduced, in particular due to the reduced wall thickness and to the construction that is suitable to the material as well as due to the observance of the geometry data, so that the quality of production is enhanced. With respect to the construction that is suitable to the material, reference is explicitly made to the fact that the angled guide plate does not have any sharp edges or radii smaller than, for example R1 to R2.

The basic body is advantageously configured substantially wedge-shaped from the supporting region to the guide region. In other words, the upper side and the underside are configured substantially wedge-shaped from the supporting region to the guide region, this being seen transversely to the track direction. The basic body preferably has a wedge shape that is configured continuously tapering from the supporting region in direction of the guide region. Thus, the angled guide plate or the basic body advantageously tapers towards the guide region. Thus, the thinner guide region compared with the supporting region also makes advantageously possible a flexibility of the angled guide plate, this being seen in a track plane. The track plane corresponds so to speak to a carriageway plane and thus constitutes a substantially horizontal plane. The torsional stiffness of the angled guide place can advantageously be influenced by the thickness of the guide region so that positional tolerances between the rail to be supported and the (railway) sleeper or the region of the (railway) sleeper on which the angled guide plate is placed can be compensated. As already mentioned, the angled guide plates are placed in corresponding engaging portions/recesses. If such recesses are not accurately aligned with the rail, if they thus are not accurately parallel, it can come to tensions when arranging the angled guide plate. An optimal arrangement, in particular a substantially tension-free arrangement can advantageously be made possible by the thin guide region, which makes possible a slight torsion or flexibility in the track plane. It is understood that the wedge shape in question has not to be continuous. This means that there can exist areas that so to speak interrupt the wedge shape. The lateral stiffness of the angled guide plate can advantageously be influenced by the wedge shape or also by one or several interruption(s) of the wedge shape. Thus, what is meant is the stiffness in the track plane. For example a "soft" angled guide plate can advantageously be produced that activates a lateral rail clamping effect or a rail fastening effect in the bottom area. In this way, a road wheel is distributed on several sleeper supporting points. The wedge shape is advantageously adapted to an effective rail contact height in order to guarantee an optimal force transmission. The wedge shape is optimally adapted to a height of the rail or of the corresponding rail base. The angled guide plate so to speak advantageously continues the shape of the rail base and thus makes possible an optimal derivation of the forces that occur when a train passes. The imaginary extension of the wedge shape of the angled guide plate appropriately merges seamlessly in the rail base in that a maximal thickness of the supporting region is adapted to the height of the rail base. Transversely to the track direction, the angled guide plate acts as a pressure wedge. This being, again the overall consideration of the basic body or of the upper side and of the underside in relation with one another is decisive. The same is valid for different cross-sections of the angled guide plate, this being seen transversely to the track direction and along this direction. There can thus exist a local cross-section area that does not have said wedge shape. The shape of the basic body as a whole is decisive.

The underside has a preferably substantially even configuration, wherein the upper side is configured arcuate and/or oblique or inclined to the under side. In other words, the upper side preferably has a curvature or a camber, wherein the curvature or the camber of the upper side is appropriately configured in direction of the underside. In a preferred embodiment, an arcuate surface merges in an upper side running obliquely/inclined to the underside. The upper side is then advantageously configured substantially bent or arcuate in the supporting region while it is configured substantially oblique or inclined to the underside in the guide region.

In a preferred embodiment, in the top view the angled guide plate is substantially configured trapezoidal, wherein a length of the supporting region is longer than a length of the guide region. Thus, a wear reduction can advantageously be achieved. This is also made possible by the high flexibility and mobility of the guide plate that is appropriately achieved in that the guide region is configured not only thinner but also narrower than the supporting region.

Appropriately, the underside has in the guide region at least one preferably bulging engaging portion that extends off the underside and along the track direction. The underside preferably has at least one engaging portion in the guide region, wherein the underside merges in a first radius into the engaging portion. Advantageously the engaging portion is designed to be arranged inside or on a corresponding engaging portion of the further element, for example of the (railway) sleeper. This being, the arrangement preferably is a form-fit arrangement. It is understood that the engaging portion advantageously extends along a length of the angled guide plate that is orientated along the track direction. But two, three, four, five or more engaging portions can advantageously be provided on the underside. However, in a particularly preferred embodiment, two engaging portions are provided, the shape, location and position of which is adapted to the (tension) clamp. The engaging portion is advantageously bulged and thus has, in a lateral view (seen along the track direction) an at least partially arcuate or circular cross-section. In other words, in a preferred embodiment the engaging portion has the shape of a triangle in the cross-section, the tip of which is rounded. The shape of a half circle or of a quarter circle is also preferred. A great advantage is that the extension or the expansion, in other words the length of the engaging portions as seen along the track direction, is optimally adapted to the forces that may occur. A particularly preferred embodiment of the engaging portion advantageously begins at one end of the angled guide plate and occupies approximately 20 to 50% of the overall length of the angled guide plate in this area, in a particularly preferred embodiment approximately 30 to 45% and most particularly preferably approximately 35 to 40%. Since two engaging portions are advantageously provided, as already mentioned, a free space or a distance is advantageously provided between the two engaging portions, this free space contributing to the cost reduction due to reduced material use. The distance preferably is approximately 0.5 to 6 cm, in particular preferably approximately 1 to 5 cm and most particularly preferably 1.5 to 4 cm.

The engaging portion advantageously forms at its surface protrusions and/or recesses that appropriately run substantially transversely to the track direction. A local flexibility of the engaging portion is thus advantageously achieved that optimizes the arrangement and the support of the engaging portion of the angled guide plate in the corresponding engaging portions of the further element. In particular, the positive locking and as a consequence the non positive locking as well with the further element, thus of the (railway) sleeper is thus increased since the protrusions and/or recesses make a resilience possible that optimizes said positive locking in that a very uniform fitting of the engaging portions as seen along and transversely to the track direction is made possible. The protrusions and/or recesses can advantageously, for example, slightly locally bend and thus be optimally adapted to the corresponding subsurface. Due to the design of the protrusions and/or recesses and the resulting resilience of the engaging portion, the fit accuracy of the engaging portion of the angled guide plate on the sublying/corresponding subsurface, generally the sleeper or a channel of the sleeper is increased. A further material saving can thus still preferentially be achieved. The material use increase due to the shaping of the engaging areas can thus be reduced again by purposefully placed recesses. The recesses are appropriately configured as grooves that substantially have the shape of a half circle or of a quarter circle, as seen transversely to the track direction. But an elliptic or an angular shape, for example in the manner of a square or of a triangle, is also conceivable. Three grooves are advantageously provided per engaging portion that run in full or also only in sections over the surface of the engaging portion, thus along an outer contour of the engaging portion. Tests have shown that the grooves appropriately do not have either to extend over the whole outer contour. Thus, it can be appropriate that the grooves extend only from a highest point of the engaging portion in direction of the supporting region. The section of the engaging portion that is so to speak turned away from the rail is preferably substantially even or at least without any particular surface structure. Due to the thus bigger contact surface, the surface pressure in this area or in this direction can intentionally be reduced. The three grooves are particularly preferably placed at an equal distance from each other, wherein however the respectively outer grooves have an unequal distance to the respective edges of the engaging portion. In particular, the distance of the most outer groove with respect to the angled guide plate is thus bigger with respect to the nearest edge of the engaging portion than the distance of the most inner groove with respect to the angled guide plate to the nearest edge of the engaging portion. Due to this asymmetrical arrangement and/or due to the afore mentioned characteristics, with the (tension) clamps that are used for W-type fastenings known from the prior art, an optimal force introduction or transmission can be achieved with the angled guide plates with a simultaneous best possible material utilization.

In a preferred embodiment, one or several recesses of the engaging portion or in the engaging portion are formed in that the underside merges in a second radius in the engaging portion, wherein the second radius is bigger than the aforesaid first radius. A rib-type engaging portion can preferably be thus produced with highest flexibility, in particular in the track direction, and with a maximum strength, in particular transversely to the track direction.

The engaging portion preferably ends at a distance in front of an end of the angled guide plate, this being seen in the track direction. In this context, it is important to mention that the engaging portion is not only provided for securing or for optimizing the guiding or the arrangement of the angled guide plate in the underlying element. Another important function of the engaging portion consists in particular in that forces of other rail fastening means, in particular of the already mentioned (tension) clamp, that are introduced into the angled guide plate by the upper side, are optimally transmitted by the engaging portion(s) to the underlying element. Thus, engaging portions are advantageously configured in the underside of the angled guide plate only where forces introduced from the upper side are to be transmitted. When using (tension) clamps known from the prior art, appropriately the engaging portion is thus not formed up to the ends of the angled guide plate so that material can additionally be saved. The surface pressure can thus also be preferably increased since the effective surface of the engaging portion is reduced. Moreover, this is also achieved by the configuration of the engaging portion with protrusions and/or recesses.

The upper side advantageously has a heel that increases the thickness of the supporting region in sections at least in part so that a stop surface for the rail is increased. In other words, the supporting area appropriately has a heel that increases the thickness of the angled guide plate at least in sections so that the stop surface for the rail is increased. The upper side of the angled guide plate is appropriately configured parallel to the underside in the area of the heel. The heel is further preferably formed in that the upper side has the already mentioned camber or curvature so that the heel is formed. The stop surface advantageously extends substantially transversely to the underside of the angled guide plate by forming the surface that directly and/or indirectly supports the rail. The heel can advantageously also extend beyond the underside. The heel makes possible a further thickening of the supporting area in sections in order to constitute an optimal positive and in particular a non-positive locking with the rail to be supported. It is understood that the heel has not to be formed continuous along the length of the angled guide plate. But the angled guide plate appropriately has corresponding heels at least at its ends in order to support the rail.

The upper side appropriately has at least one force introduction area, wherein the at least one force introduction area is formed as a material thickening and/or material thinning with respect to the basic body. As already mentioned, the force introduction areas substantially serve for absorbing and transmitting the forces that can occur when arranging further rail fastening elements such as, for example, (tension) clamps. In particular, the force introduction areas serve to absorb forces that act substantially approximately transversely to the underside of the angled guide plate. Following the idea of this very invention, the basic body has a substantially even surface plane and has a material thickening or, if need be, a material thinning only in those locations that serve for introducing forces, for example through rail fastening means such as (tension) clamps or the like. Material is thus used very purposefully and only where it is mandatorily needed.

Appropriately, at least one force introduction area is formed as a recess in the guide region that extends substantially along the track direction and that reduces the thickness of the angled guide plate in this region. The recess is advantageously formed substantially with a circular segment or rounded cross-section, this being seen along the track direction. The recess is advantageously formed for arranging a rail fastening means, for example a (tension) clamp. In a preferred embodiment, two such recesses are placed at a distance along the length of the angled guide plate the one after the other. The distance preferably is approximately 0.5 to 7 cm, in particular preferably approximately 1 to 5 cm and most particularly preferably approximately 1.5 to 4 cm. In a preferred embodiment, the recess is limited along the track direction in its entirety or at least in sections by a transition section towards the supporting region. The transition section has approximately a cross-sectional shape of a triangle, this being seen along the track direction that extends away from the upper side of the basic body and thus continues the contour or the surface of the recess beyond the upper side. The arrangement of rail fastening means is thus still further optimized since the surface of the recess, thus of the force introduction area, is increased.

The force introduction area in the guide region and the at least one engaging portion on the underside are advantageously placed facing each other. The angled guide plate as a whole can thus advantageously be formed extremely thin in the guide region, in particular thinner than in the supporting region. The angled guide plate is advantageously thickened or reinforced by using at least one engaging portion only locally where forces have to be introduced. This configuration complying with the flow of forces makes possible an optimal material utilization and thus a cost-effective manufacturing. It should not be forgotten that a very big number of such angled guide plates is required for fastening the rails so that even minimal savings in material result in total to a considerable cost advantage. Appropriately, a recess and an opposed engaging portion extend over the same or substantially the same length, this being seen along the track direction. Two recesses are advantageously provided that are placed opposite two engaging portions of the same length.

Appropriately, a material thinning and/or a material recess is placed between two recesses or engaging portions placed along the track direction. A purposeful introduction of forces is thus made possible. It has already been mentioned that in a preferred embodiment two engaging portions are placed on the underside or two recesses are placed on the upper side the one behind the other at corresponding distances. The material thinning and/or the material recess is advantageously configured in these intervals or in the area of these intervals, for example with the shape of a hole. In other words, the distance can also be formed precisely by the material thinning or the material recess. The material thinning is to be interpreted in that the thickness of the guide region is still further reduced in this region that is anyway already very thin. It is thus advantageously possible that the two recesses and the correspondingly facing engaging portions on the underside of the angled guide plate ideally absorb the forces of the rail fastening element, for example of the (tension) clamp, and transmit them to the further element, for example to the (railway) sleeper. Tests resulted in that—in simplified words—the areas between the recesses or between the engaging portions are not needed so that they can advantageously be so to speak "omitted" by the material thinning or the material recess. It is understood that a further material saving and thus cost saving is also made possible precisely by these features.

The angled guide plate preferably forms a bulge on the outside of the guide region along the track direction that is preferably adjacent to the at least one recess. The recess and the bulge advantageously merge in a bend or in a curve. The bulge preferably achieves a local thickening of the guide region. This thickening advantageously serves to place the rail fastening means, for example to support a (tension) clamp, this being seen transversely to the track direction. On the other hand, the arrangement or the positive locking of the angled guide plate on the further element, for example on the (railway) sleeper, can thus also be optimized. In this way, the guide region of the angled guide plate is fundamentally configured already very thin at the outer end in question here so that it can be advantageous to increase the thickness of the guide region on its outside at least in sections with a protrusion such as a bulge or the like. The contour of the recess advantageously merges directly in the bulge so that the bulge and the recess form in cross-section a continuous contour.

Appropriately, at least one force introduction area that extends substantially away from the upper side and that serves for supporting a fastening means, in particular a (tension) clamp, is formed in the supporting region. The force introduction area in the supporting region advantageously represents an additional thickening in order to optimally support fastening means to be placed and to optimize the introduction of forces.

Appropriately, the force introduction area in the supporting region is formed by two protrusions that are placed offset along the track direction and that have respectively one bearing surface for placing the fastening means that extends substantially transversely to the track direction. The bearing surfaces preferably have substantially the shape of a circle segment, this being seen along the track direction. Generally, the shape or the configuration of the bearing surfaces is advantageously adapted to the shape of the corresponding fastening means that is used. In order to increase the stability and the strength, the protrusions are connected by at least one web that extends along the track direction.

The angled guide plate advantageously has a recess, for example shaped as a hole, for traversing a fastening means, in particular a (sleeper) screw. The recess is advantageously placed in the supporting region but it can also extend into the guide region or also be placed only in this region.

Preferably, a length of the supporting region is bigger than a length of the guide region. In a top view, the angled guide plate is also advantageously formed approximately trapezoid. The length of the guide region is preferably approximately 1 to 20% shorter than the length of the supporting region, particularly preferably approximately 2 to 15%, most particularly preferably approximately 3 to 10%.

In order to limit the need of material to a minimum, the angled guide plate has advantageously on its underside one or several pockets that are dimensioned to still further reduce the thickness of the basic body in sections or in portions. A configuration for which the pocket extends perpendicularly away from the stop surface over the whole length of the supporting region in direction of the guide region has proved particularly advantageous with a shape for which the thickness of the basic body is not further reduced in the area of the edges of the basic body, in particular in the supporting region (apart from the section in the area of the stop) and in the area around the recess. The pockets advantageously end in front of the engaging portions.

The areas the thickness of which is not reduced advantageously form force transmission areas. The matter is thus, for the force transmission areas, of the areas on the underside of the angled guide plate that are in contact with the (railway) sleeper. The force transmission areas are advantageously just as big or only as wide so that the forces introduced from the upper side of the angled guide plate, in particular the clamping forces, are sufficiently supported.

According to the invention, a track arrangement has an angled guide plate according to the invention. It is understood that all the characteristics and advantages of the angled guide place also apply to the track arrangement.

Further advantages and characteristics result from the following description of preferred embodiments of the angled guide plate according to the invention as well as of the track arrangement according to the invention with reference to the attached drawings. This being, single characteristics of the single embodiments can be combined with each other within the scope of the invention.

DETAILED DESCRIPTION OF THE PREFERRED EMBODIMENTS

Figure 1:
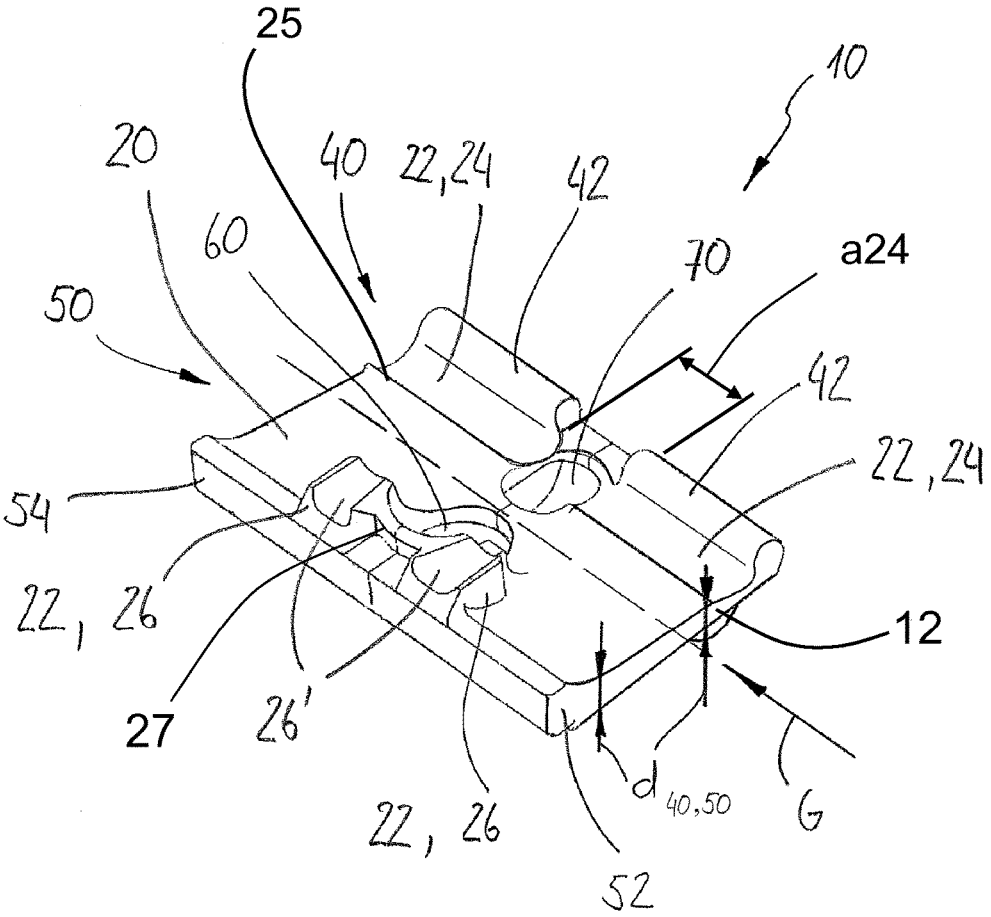
FIG. 1 shows a perspective view of a preferred embodiment of an upper side of an angled guide plate.

FIG. 1 shows a perspective view of a preferred embodiment of an upper side 20 of an angled guide plate 10. The angled guide plate 10 has a basic body 12 and extends along a track direction G. A (imaginary) separation line between a guide region 40 and a supporting region 50 is represented as a dotted line along the track direction G. It can be clearly seen that a thickness $d_{50}$ (selected as an example) of the supporting region 50 is bigger than a thickness $d_{40}$ (selected as an example) of the guide region 40. The supporting region 50 has a force introduction area 22 configured by two protrusions 26. The protrusions 26 are connected with each other along the track direction G by a web 27. Furthermore, the supporting region 50 has a heel 52 towards the rail (that is not represented here) that increases a stop surface 54 of the basic body 12 that extends substantially perpendicularly to an underside 30. The guide region 40 has two force introduction areas 22 configured as recesses 24 that are placed at a distance along the track direction G the one behind the other. A material thinning or a material recess 70 shaped as a hole is configured between the two recesses 24. The recesses 24 are placed at a distance a24 along the track direction G. The recesses are limited on the upper side 20 towards the supporting region 50 by a transition section 25 that is configured for its part as an elevation with an approximately triangular cross-section.

Figure 2:
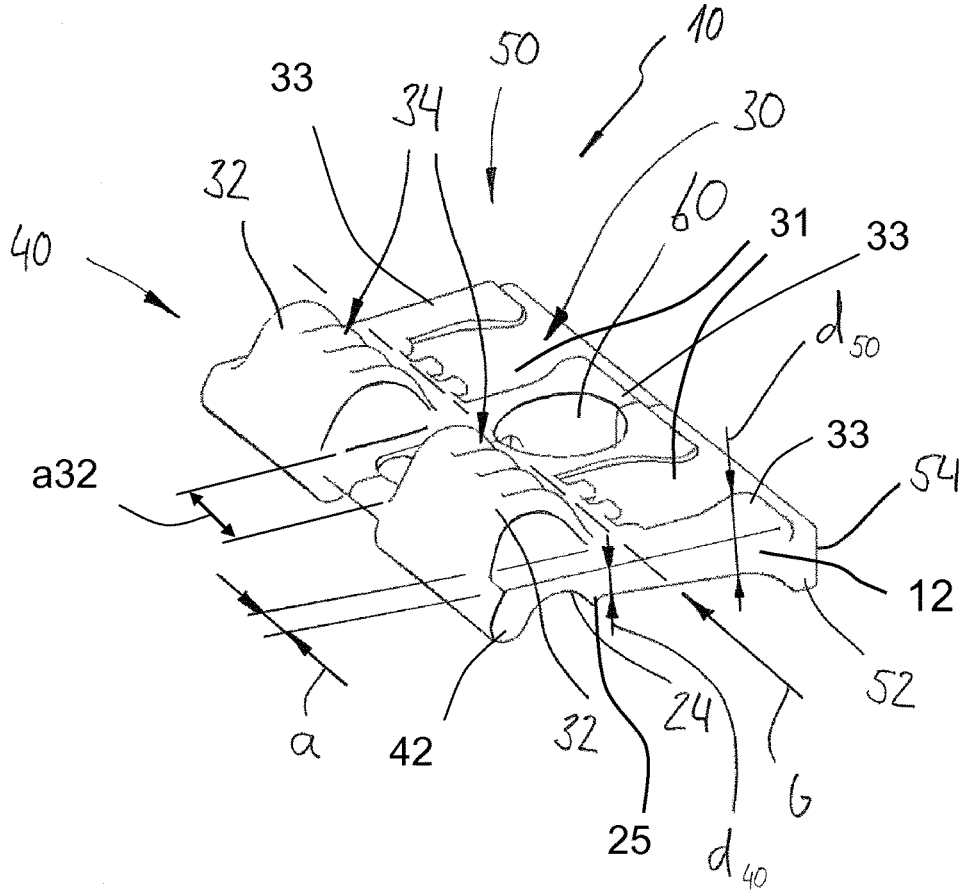
FIG. 2 shows a perspective view of a preferred embodiment of an underside of the angled guide plate known from FIG. 1.

FIG. 2 shows a perspective view of a preferred embodiment of an underside 30 of the angled guide plate 10 known from FIG. 1 with the basic body 12. The guide region 40 has two bulged engaging portions 32 along the track direction G, these engaging portions having protrusions and/or recesses or grooves 34 on their surface. A recess 24 can be seen in outlines on the front side of the angled guide plate 10 opposite the engaging portions 32. The angled guide plate 10 has corresponding bulges 42 on the outside adjacent to the recess 24. The transition section 25 is configured opposite the bulges. The two engaging portions 32 are placed at a distance a32 along the track direction G. The engaging portions 32 are placed offset to the edge of the angled guide plate 10 by a distance a. For the preferred embodiment represented in FIG. 2, the underside 30 is not configured entirely even but has pockets 31 that make possible an additional saving of material. Force transmission areas 33 that serve as contact surfaces for a not represented (railway) sleeper correspond to the pockets 31.

Figure 3A:
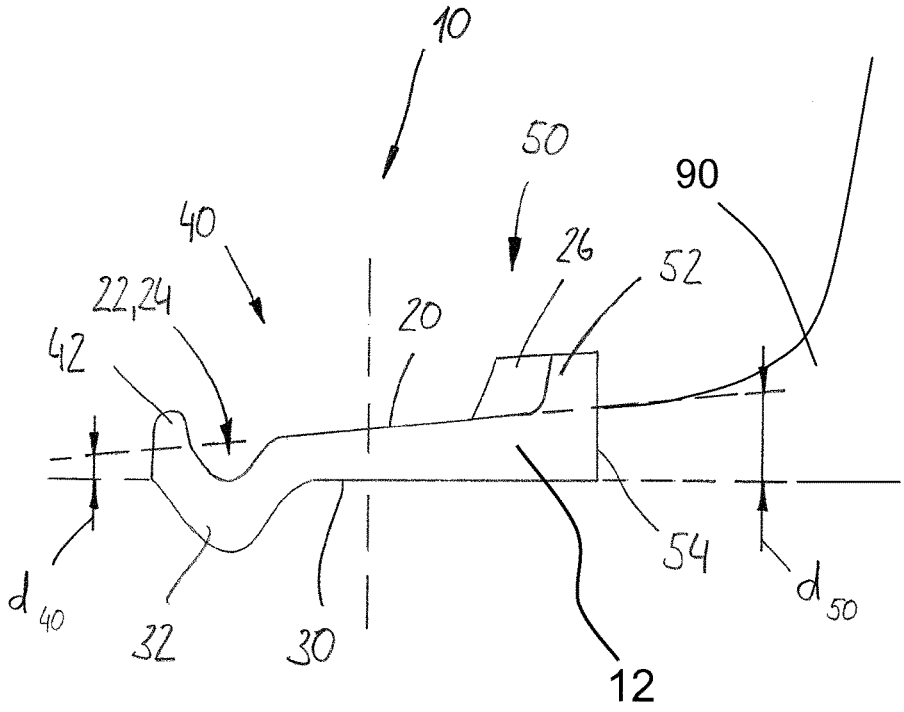
FIG. 3*a* shows a lateral view of a schematic diagram of a preferred embodiment of an angled guide plate.

FIG. 3*a* shows a lateral view of a schematic diagram of an angled guide plate 10. The wedge shape of the basic body 12 that comprises an upper side 20 and an underside 30 can be clearly seen. It is suggested by the dotted lines that the basic body 12 is essential for determining the thickness $d_{40}$ and $d_{50}$ of the angled guide plate and that local elevations or recesses or the like are not to be considered for calculating or determining the thickness. The wedge shape is advantageously optimally adapted to the rail 90 or to the rail base. The angled guide plate continues so to speak the shape of the rail base and thus makes an optimal derivation of the forces occurring when a train passes. The imaginary extension of the wedge shape of the angled guide merges almost without a transition into the rail base so that a maximal thickness d50 of the supporting region is adapted to a height of the rail base. The angled guide plate 10 schematically represented in FIG. 3*a* has a protrusion 26 on its upper side as well as a force introduction area 22 configured as a recess 24. A bulge 42 is adjacent to the recess 24. An engaging portion 32 that extends away from the upper side 30 is formed below the recess 24. A supporting region 50 has a stop surface 54 on its end orientated towards a rail (that is not represented here). The vertical dotted line indicates a supporting region 50 and a guide region 40.

Figure 3B:
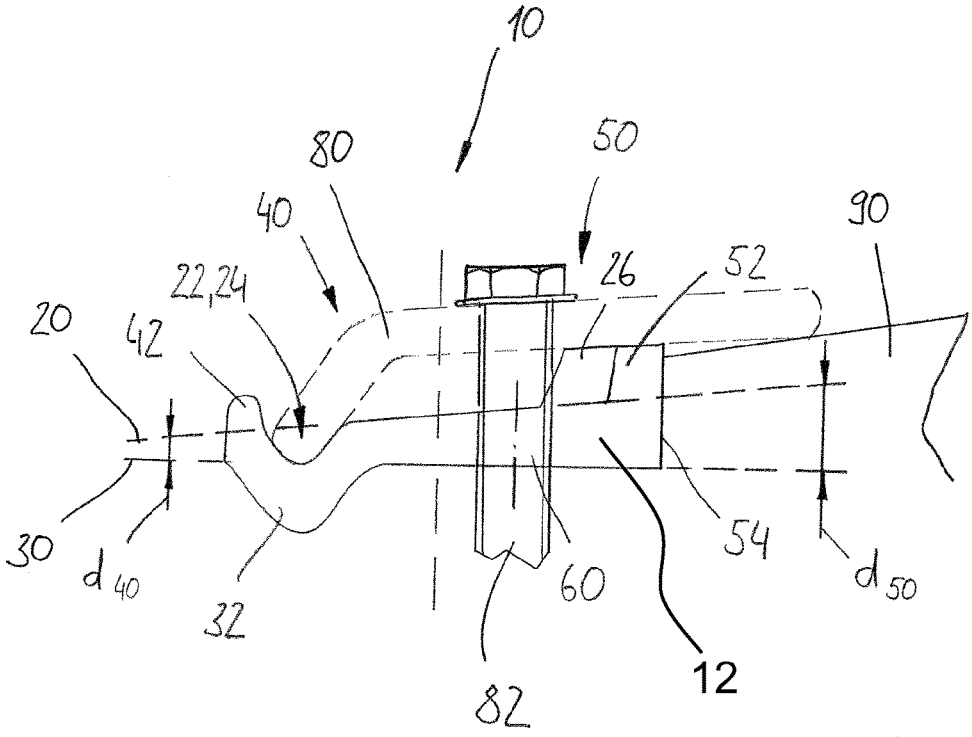
FIG. 3*b* shows a schematic diagram of a preferred embodiment of an angled guide plate in an assembly situation.

FIG. 3*b* shows the schematic diagram known from FIG. 3*a* in a mounting situation. A (tension) clamp 80 is placed on the angled guide plate 10 in a recess 60 by a (sleeper) screw 82. The (tension) clamp 80 bears on the protrusions 26 and the recess 24. A rail 90, in particular a rail base, that is locked from above by the tension clamp is placed on the stop surface 54.

Figure 4:
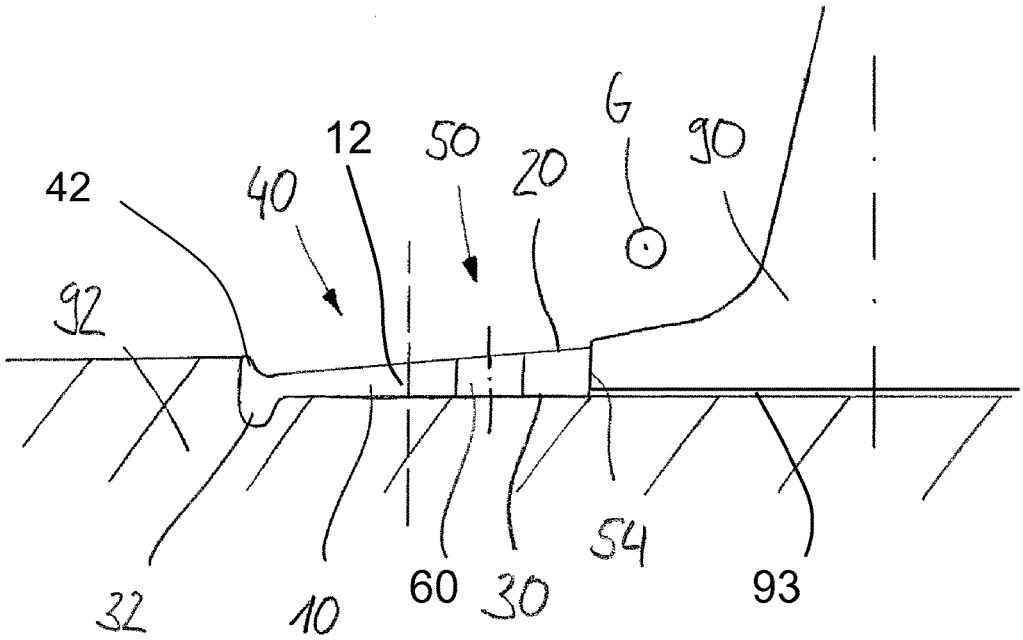
FIG. 4 shows a sketched illustration of a track arrangement.

FIG. 4 shows a schematic diagram of a preferred embodiment of a track arrangement. An angled guide plate 10 is represented in a section so that a recess 60 for arrangement, for example, of a corresponding fastening means (that is not represented here) is possible. The angled guide plate 10 is placed with an underside 30 on a (railway) sleeper 92 that is represented crosshatched here. An engaging portion 32 of a guide region 40 of the angled guide plate 10 engages into a corresponding form of the (railway) sleeper 92. The angled guide plate 10 shows on an upper side 20 thereof a bulge 42 for arranging on the (railway) sleeper 92. The angled guide plate 10 is placed over a stop surface 54 on a rail 90 that extends along a track direction G. The rail 90 stands on an intermediate layer 93.

Figure 5:
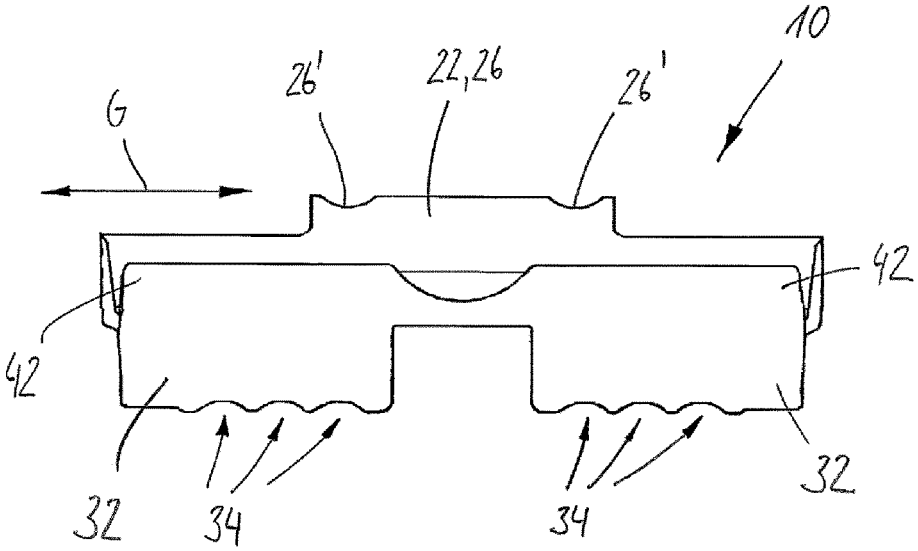
FIG. 5 shows a view of a preferred embodiment of an angled guide plate transversely to a track direction with a direction of view from a guide region to a supporting region.

FIG. 5 shows a view of a preferred embodiment of an angled guide plate 10 transversely to a track direction G with view from a guide region to a supporting region (here without reference numerals). Two engaging portions 32 that have respectively three grooves 34 are clearly to be seen. The grooves 34 are placed at an equal distance from each other, wherein they are however offset inwards with respect to the respective engaging portion 32. Furthermore, a force introduction area 22 that is configured by two recesses 26 and comprises two bearing surfaces 26' is shown. The engaging portions 32 merge directly into bulges 42 attached thereto.

Figure 6:
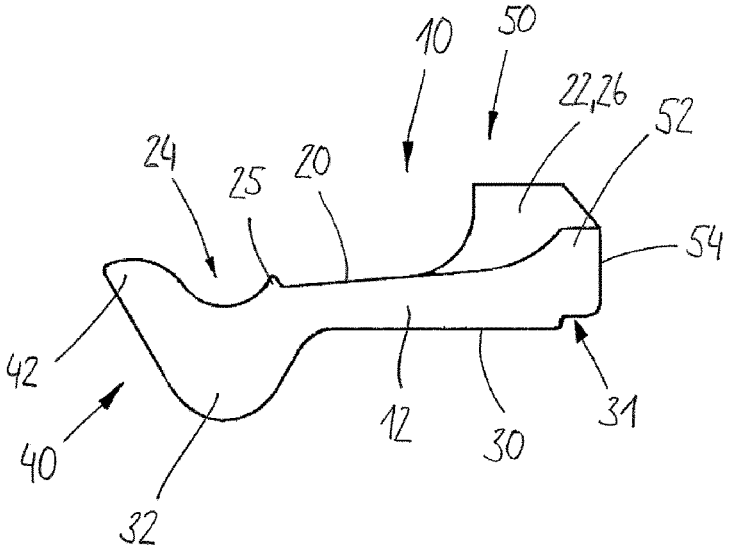
FIG. 6 shows a lateral view of a further preferred embodiment of an angled guide plate.

FIG. 6 shows a lateral view of a further preferred embodiment of an angled guide plate 10. Again the wedge shape of a basic body 12 that has an upper side 20 and an underside 30 and that tapers from the supporting region 50 to the guide region 40 can be recognized. A force introduction area 22 configured as a recess 26 extends away from the upper side 20. The supporting region 50 is limited towards a rail (that is not represented here) by a heel 52 with a stop surface 54. A pocket 31 is also placed in this area on the underside 31. An engaging portion 32 is configured opposite a recess 24. The guide region 40 ends in a bulge 42 that in its part seamlessly merges into the recess 24. The recess 24 is limited towards the upper side 20 by an approximately triangular transition section 25.

Figure 7:
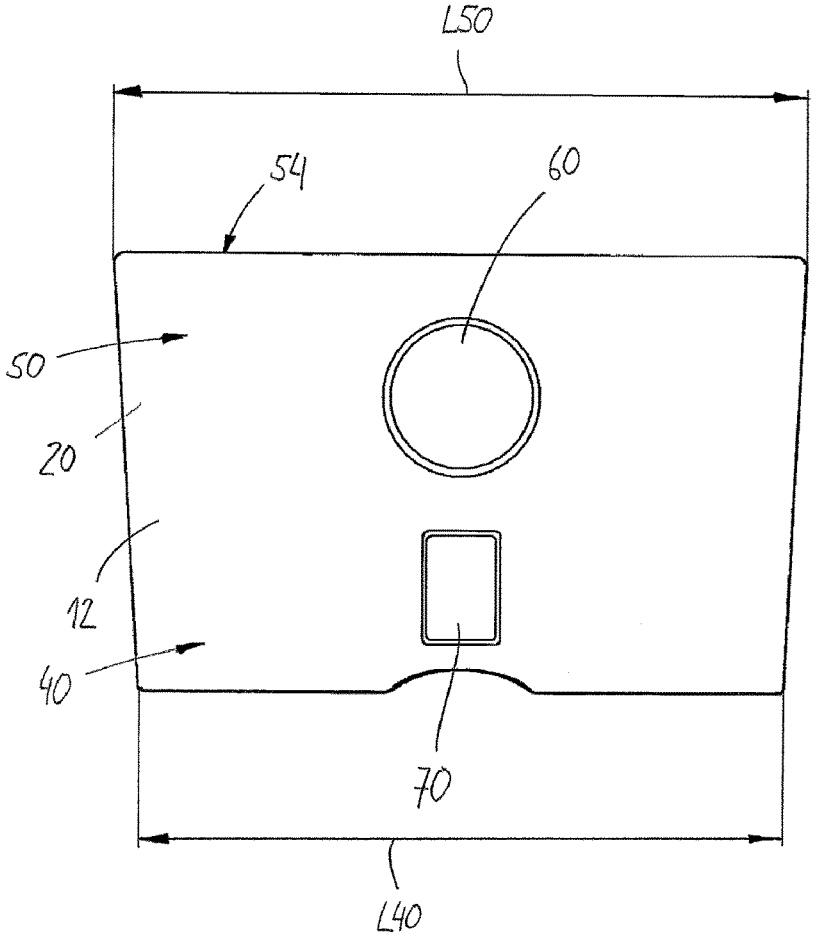
FIG. 7 shows a schematic top view of an upper side of an angled guide plate.

FIG. 7 shows a schematic top view of an upper side 20 of a trapezoid configured angled guide plate 10. The different lengths of the supporting region L50 and of the guide region L40 that contribute to the wear reduction of the angled guide plate are clearly to be recognized. A basic body 12 comprises a recess 60 as well as a material recess 70 with the shape of a hole. The representation of further characteristics has not been added in this illustration.

Figure 8:
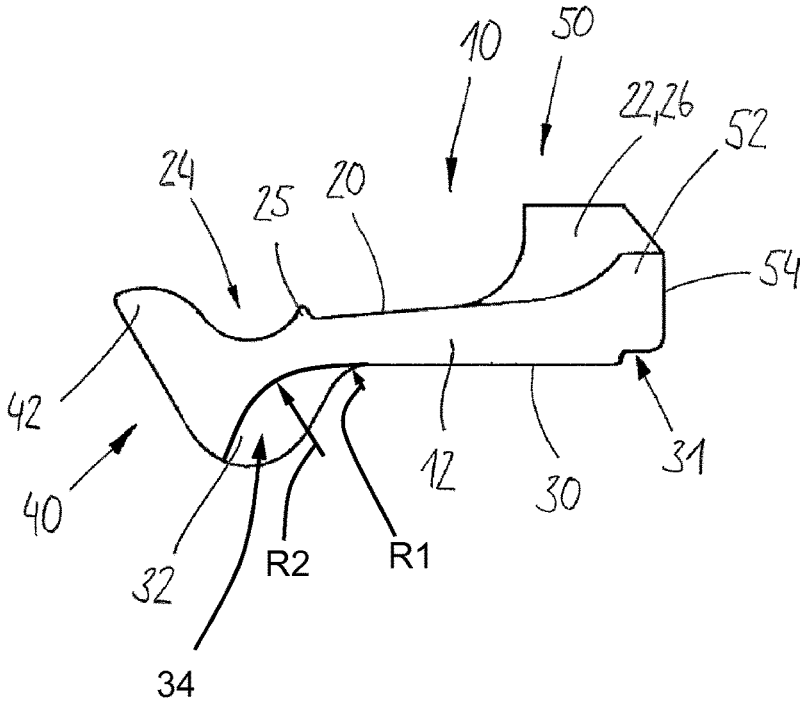
FIG. 8 shows a lateral view of a further preferred embodiment of an angled guide plate.

FIG. 8 substantially shows the embodiment known from FIG. 7, wherein an engaging portion 32 is formed in that an underside 30 merges in a first radius therein. One or several recesses are formed in that the underside merges in a second radius R2 into the engaging portion, wherein the second radius is bigger than the first radius.

LIST OF REFERENCE NUMBERS

10 Angled guide plate
12 Basic body
20 Upper side
22 Force introduction area
24 Recess
25 Transition section
26 Protrusion
26' Bearing surface
27 Web
30 Underside
31 Pocket
32 Engaging portion
33 Force transmission area
34 Protrusions and/or recesses, grooves
40 Guide region
42 Bulge
50 Supporting region
52 Heel
54 Stop surface
60 Recess
70 Material thinning and/or material recess
80 Fastening means, (tension) clamp
82 Fastening means, (sleeper) screw
90 Rail
92 (Railway) sleeper
93 Intermediate layer
a24, a32 Distance
L40, L50 Length
$d_{40}$ Thick guide region
$d_{50}$ Thick supporting region
G Track direction
R1 First radius
R2 Second radius

The invention claimed is:

1. An angled guide plate for rail fastening systems, comprising:

a basic body having an upper side and an underside;

wherein the underside is configured to be arranged on a sleeper, wherein the upper side includes an opposite plane substantially transversely to the sleeper, and wherein the angled guide plate includes a guide region and a supporting region; and wherein the guide region and the supporting region extend substantially parallel and adjacent to one another in a direction transverse to a track direction;

wherein the upper side and the underside are spaced apart from one another so that a thickness of the supporting region, as measured substantially perpendicularly to the underside, is larger than a thickness of the guide region;

wherein the basic body includes a wedge-shaped portion that is substantially wedge-shaped from the supporting region to the guide region substantially perpendicular to the track direction;

wherein a minimal thickness of the guide region is smaller than 10 mm; and wherein the wedge-shaped portion of the basic body is configured to continue a general shape of a rail base in a direction substantially perpendicular to the track direction such that substantial upper surfaces of the supporting and guide regions lie on an angled plane containing a substantial upper surface of the rail base.

2. The angled guide plate according to claim 1, wherein the underside is substantially planar and wherein the upper side is at least one of arcuate and inclined toward the underside.

3. The angled guide plate according to claim 1, wherein the angled guide plate is substantially trapezoidal-shaped as seen in top view, wherein a length of the supporting region is longer than a length of the guide region.

4. The angled guide plate according to claim 1, wherein the underside includes at least one engaging portion in the guide region, and wherein the underside merges in the engaging portion in a first radius.

5. The angled guide plate according to claim 4, wherein the at least one engaging portion includes at least one of protrusions and recesses on a surface of the engaging portion that run substantially transversely to the track direction.

6. The angled guide plate according to claim 5, wherein the recesses of the engaging portion are located in the underside, and wherein the underside merges in a second radius in the engaging portion that is bigger than the first radius.

7. The angled guide plate according to claim 4, wherein the engaging portion ends in front of an end of the angled guide plate at a distance along the track direction.

8. The angled guide plate according to claim 1, wherein the supporting region includes a heel that increases the thickness of the angled guide plate in sections at least in part so that a stop surface for a rail is increased.

9. The angled guide plate according to claim 1, wherein the upper side includes at least one force introduction portion, and wherein the at least one force introduction portion includes at least one of a material thickening and a material thinning with respect to the basic body.

10. The angled guide plate according to claim 9, wherein the at least one force introduction portion is configured as a recess in the guide region that extends substantially along the track direction and that reduces the thickness of the angled guide plate.

11. The angled guide plate according to claim 10, wherein the underside includes at least one engaging portion, wherein the at least one force introduction portion in the guide region and the at least one engaging portion are arranged one above the other.

12. The angled guide plate according to claim 10, wherein at least one of a material thinning and a material recess is located between at least one of two recesses and two engaging portions along the track direction.

13. The angled guide plate according to claim 1, wherein the angled guide plate includes a bulge on an outside on the guide region along the track direction.

14. The angled guide plate according to claim 1, wherein at least one force introduction portion extends substantially away from the upper side and supports a fastener in the supporting region.

15. A track arrangement with an angled guide plate according to claim 1.

* * * * *